US007920121B2

(12) United States Patent
Shen et al.

(10) Patent No.: US 7,920,121 B2
(45) Date of Patent: Apr. 5, 2011

(54) DRIVING METHOD OF LIQUID CRYSTAL DISPLAY DEVICE HAVING DYNAMIC BACKLIGHT CONTROL UNIT

(75) Inventors: Yuh-Ren Shen, Hsinchu (TW); Chang-Cheng Lin, Hsinchu (TW); Cheng-Chung Peng, Hsinchu (TW); Chih-Hao Wu, Hsinchu (TW)

(73) Assignee: VastView Technology Inc., Hsinchu (TW)

( * ) Notice: Subject to any disclaimer, the term of this patent is extended or adjusted under 35 U.S.C. 154(b) by 1013 days.

(21) Appl. No.: 11/790,528

(22) Filed: Apr. 26, 2007

(65) Prior Publication Data

US 2008/0266236 A1 Oct. 30, 2008

(51) Int. Cl.
*G09G 3/36* (2006.01)

(52) U.S. Cl. ..... 345/102; 345/87; 345/204; 345/211; 345/212; 345/690

(58) Field of Classification Search ..... 345/55, 345/84, 87, 102, 204, 211, 212, 690
See application file for complete search history.

(56) References Cited

U.S. PATENT DOCUMENTS

| | | | | |
|---|---|---|---|---|
| 6,388,388 | B1 * | 5/2002 | Weindorf et al. | 315/169.3 |
| 6,762,741 | B2 * | 7/2004 | Weindorf | 345/102 |
| 7,460,103 | B2 * | 12/2008 | Konno et al. | 345/102 |
| 2005/0248555 | A1 * | 11/2005 | Feng et al. | 345/204 |

* cited by examiner

*Primary Examiner* — My-Chau T Tran
(74) *Attorney, Agent, or Firm* — Bacon & Thomas, PLLC

(57) ABSTRACT

A dynamic control method for controlling backlight module of liquid crystal display (LCD) comprises steps of: receiving a frame data which is transferred to the LCD and consists a plurality of raw grayscale level; processing a statistical analysis for distribution of the plurality of raw grayscale level; and transferring a plurality of corrected grayscale level which is resulted from the statistical analysis corresponding to the raw grayscale level to the backlight control unit and a data modification simultaneously, wherein the backlight control unit uses the plurality of corrected grayscale level to modify brightness of backlight module and the data modification uses the plurality of corrected grayscale level to compare with the plurality of raw grayscale level for accurate display performance, so that the electrical power consumption is reduced and image quality is enhanced.

24 Claims, 7 Drawing Sheets

DRIVING METHOD OF LIQUID CRYSTAL DISPLAY DEVICE HAVING DYNAMIC BACKLIGHT CONTROL UNIT

BACKGROUND OF THE INVENTION

1. Field of the Invention

The present invention relates to a driving method of an LCD device having a backlight module with dynamic backlight control unit, and more particularly for controlling backlight module of LCD which dynamically adjusts backlight brightness from grayscale level distribution of the display by frame data analysis. Due to dynamically adjusting backlight brightness, electric power consumption can be diminished and display quality can be enhanced.

2. Description of the Prior Art

Conventional backlight module of LCD is illustrated as FIG. 1. A backlight module 9 as shown on FIG. 1 includes a diffuser 91, a reflector 92 and a plurality of light source 93, wherein the reflector and plurality of light source are on the side of the diffuser and the plurality of light source is distributed between the reflector and diffuser regularly. Reflecting side 921 of the reflector comprises transverse concaves which have the plurality of light source on their focus and reflects light to the diffuser. Light from the plurality of light source can directly go through the diffuser and can be reflected by the reflector to the diffuser. Intensity or brightness of light source is controlled by a controller (not shown on FIG. 1). In general, the light source can be cold cathode fluorescent lamp (CCFL) as cylinders 93 on FIG. 1. The controller for CCFL is inverter controller (not shown on FIG. 1) which controls brightness of CCFL by pulse width modulation (PWM). As LCD developing, strip lamp 94 formed by light emitting diodes 941 (LEDs) in serial on strip board 942 can be the light source of LCD instead of CCFL. The PWM of strip lamp is controlled by LED driver controller (not shown on FIG. 1).

As increasing size of LCD, number and intensity of the light source (CCFL 93 or strip LED lamp 94) increase too. Electric power consumption increases also. In an exemplary LCD with 65-inch panel, electric power consumption for turning on the backlight module 9 is greater than 700 W as well as an operating heater. The worse is only two stages for backlight module operation, on or off. Event in a dark scent, brightness of backlight module is in full intensity and dark scene is made by controlling rotation angle of liquid crystal molecule. In a long term, electric power consumption is substantial. How to lower down electric power consumption becomes therefore an important issue for saving power as LCD developing.

Thus, inventors depending on their abundant experience on LCD design and producing figure out the present invention for solving mentioned problems after many cycles of consideration, produce, and modification.

SUMMARY OF THE INVENTION

An object of the present invention is to provide a dynamic control method for controlling backlight module of LCD, wherein electric power consumption by backlight module can be lower down to save money and power.

Another object of the present invention is to provide a dynamic control method for controlling backlight module of LCD, wherein brightness of backlight module is dynamically adjusted with grayscale level distribution in different frame data to lower down electric power consumption.

Another object of the present invention is to provide a dynamic control method for controlling backlight module of LCD, wherein scene contrast is improved and display quality is improved as well.

In order to achieve the above objects in the present invention, the method of driving a liquid crystal panel according to one aspect of the present invention having backlight of the LCD is provided by a plurality of light source of backlight module and controlled by a backlight control unit. And, the dynamic control method for controlling backlight module of LCD according to the present invention comprises the following steps: receiving a frame data which is transferred to the LCD and consists a plurality of raw grayscale level; processing a statistical analysis for distribution of the plurality of raw grayscale level; and transferring a plurality of corrected grayscale level which is resulted from the statistical analysis corresponding to the raw grayscale level, wherein the backlight control unit uses the plurality of corrected grayscale level to modify brightness of backlight module.

Furthermore, a weighted-average of the raw grayscale level is calculated in the step of processing statistical analysis for uses of further analysis and determinant conditions. Additionally, a most significant bit (MSB) of the plurality of raw grayscale level resulted from a manner of bit truncation can be used to reduce data processing during the step of processing statistical analysis.

In the present invention, all the brightness of light source of backlight module can be changed by the same amount for whole brightness modification. The brightness of light source of backlight module on the same strip board can be changed by the same amount for strip-wise brightness modification. The brightness of light source of backlight module on the same area board can be changed by the same amount for area-wise brightness modification.

For a more complete understanding of the features and advantages of the present invention, reference is now made to the following description taken in conjunction with accompanying drawings, in which

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

A color image can be performed by RGB additive primaries. Different grayscale level of primary represents different primary brightness. In the following embodiment description, a single grayscale level with 8-bit resolution, i.e. using digits 0~255 to present different brightness between full dark to full white, is used for clear understanding.

Generally, a LCD consists of a backlight module and a backlight control unit to drive the backlight and control the operation of the backlight so that it emits light always at a specified level of brightness. The backlight module consists of a plurality of light source, which are provided by CCFL, LCD or other operable illumination devices, for backlight of LCD.

Figure 1:
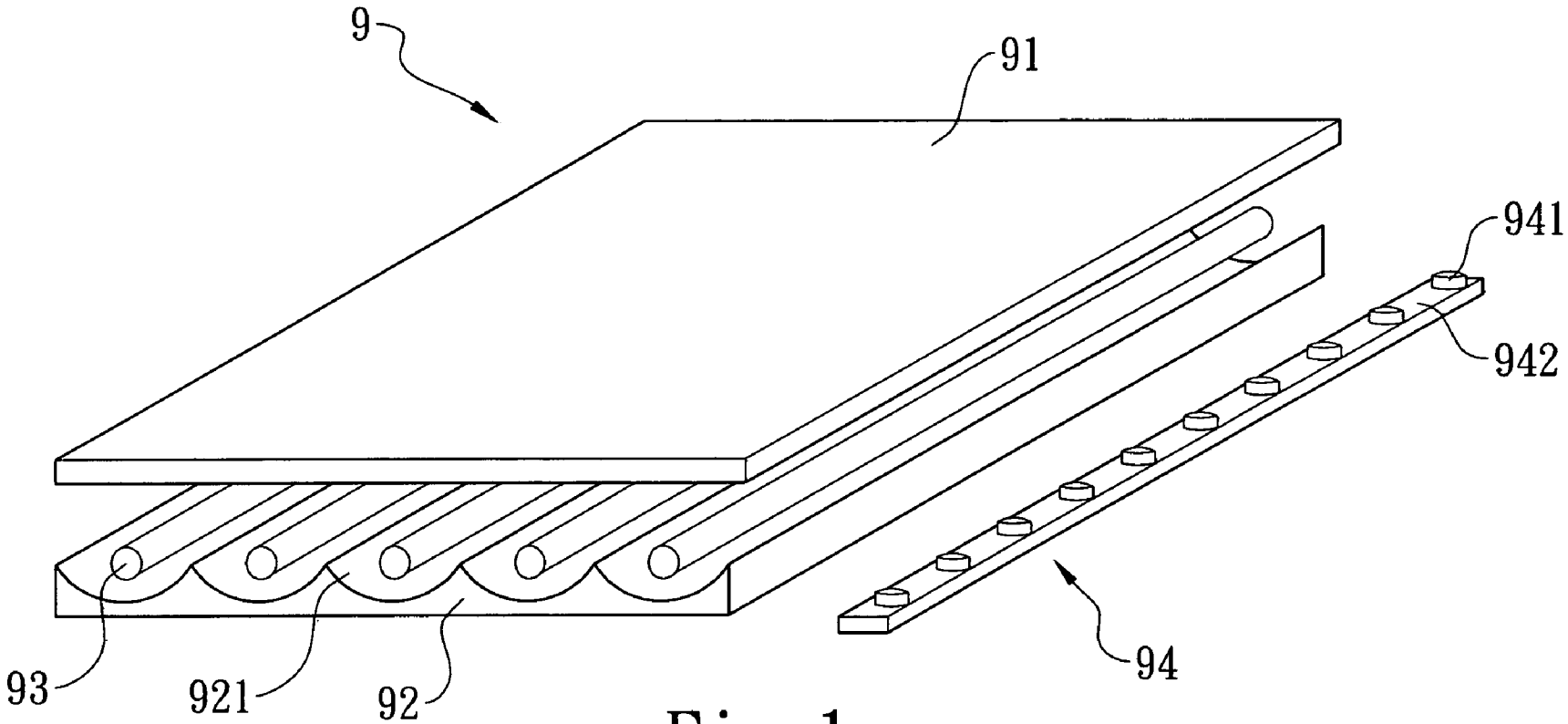
Fig. 1 (Prior Art)
FIG. 1 illustrates a prior art to show structure diagram of backlight module.
Figure 2:
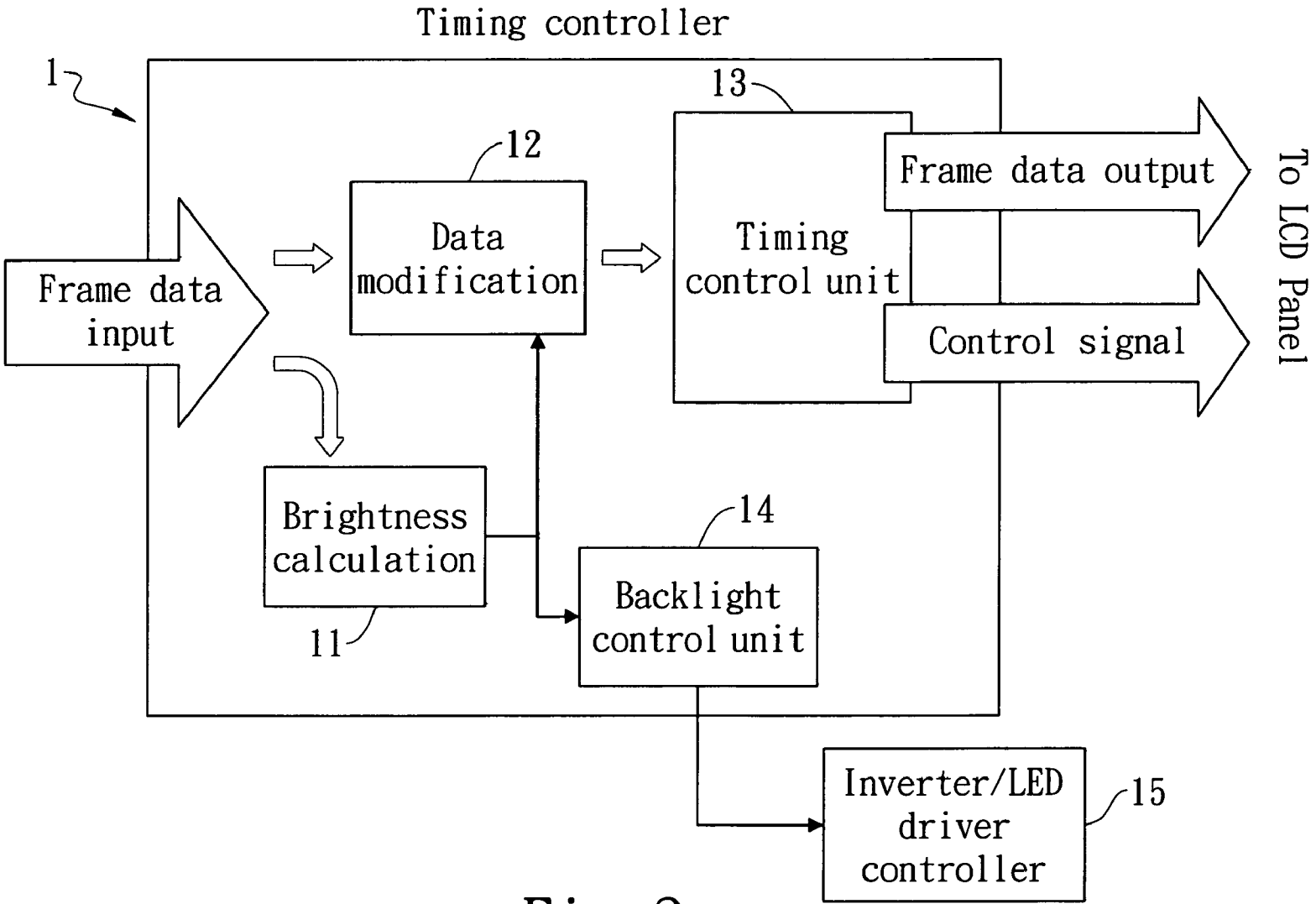
FIG. 2 shows a flowchart of timing controller according to the present invention.

Based on an operation for a timing controller 1 of LCD, an embodiment according to the present invention is shown on FIG. 2. As a frame data is received by the LCD through the timing controller, a plurality of raw grayscale level in the frame data is transferred to a brightness calculation 11 and a data modification 12 respectively. The brightness calculation gathers all the raw grayscale level to do a statistics of brightness distribution. According to the results from statistics of brightness distribution, the following statistic analysis and determinant operations can generate a plurality of corrected grayscale level corresponding to the raw grayscale level.

The plurality of corrected grayscale level is further transferred to data modification 12 and backlight control unit 14 at the same time for synchronization. In the data modification 12, the plurality of corrected grayscale level is compared with the plurality of raw grayscale level and a plurality of optimized grayscale level is generated and sent to a timing controller 13 for image optimization. Finally, the timing controller sends the plurality of optimized grayscale level and control signal to LCD panel for controlling rotation of liquid crystal molecule and panel brightness.

When the plurality of corrected grayscale level is transferred to the backlight control unit, an inverter or a LED driver controller (as mark 15 on FIG. 2) is used to control the intensity of light source in backlight module. According to the corrected grayscale level, brightness of backlight module can be modified for different purposes. In an exemplary dark image, i.e. grayscale level distribution in low level, brightness of backlight module is modified to a lower intensity for saving electrical energy.

Figure 3:
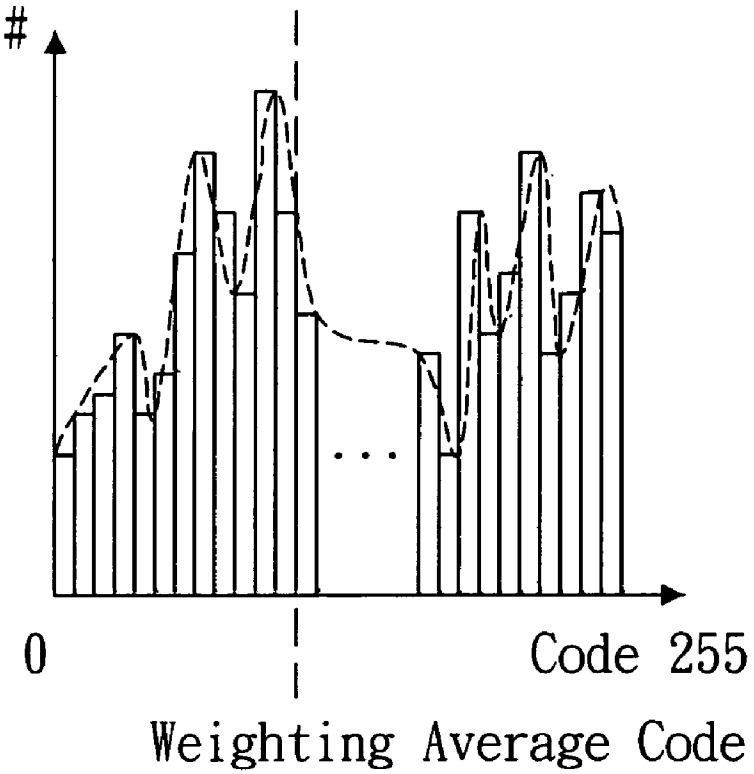
FIG. 3 is an exemplary histogram diagram of raw grayscale level according to the present invention.

As an exemplary histogram of brightness distribution on FIG. 3, X represents grayscale level 0~255 and Y represents number distribution in the frame data. Brightness distribution and weighting is easy to show on the histogram. According to the histogram, a weighted-average of the raw grayscale level is calculated in the step of processing statistical analysis for uses of further analysis and determinant conditions.

Figure 4:
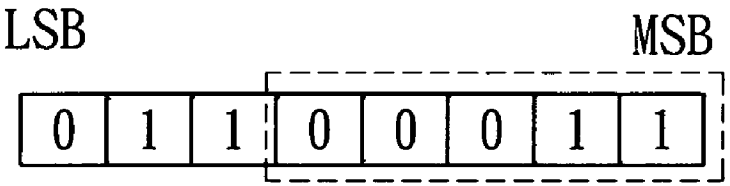
FIG. 4 is a schematic diagram of bit truncation according to the present invention.

Before gathering brightness histogram, the bits of raw grayscale level can be truncated and represented as most significant bit (MSB) through a manner of bit truncation for reducing data process. As shown on FIG. 4, the 8 bits of raw grayscale level is truncated as 5 bits, wherein 3 least significant bits (LSBs) is truncated and 5 MSBs is left to represent raw grayscale level. Although there are 7-digits resolution is sacrificed for dropping 3-bit LSB, amount of processing information is dramatically reduced from 8-bit to 5-bit. Seven-digit sacrifice in image quality is hard to tell by human's eyes, so the huge reduction of processing time is worth.

Figure 5A:
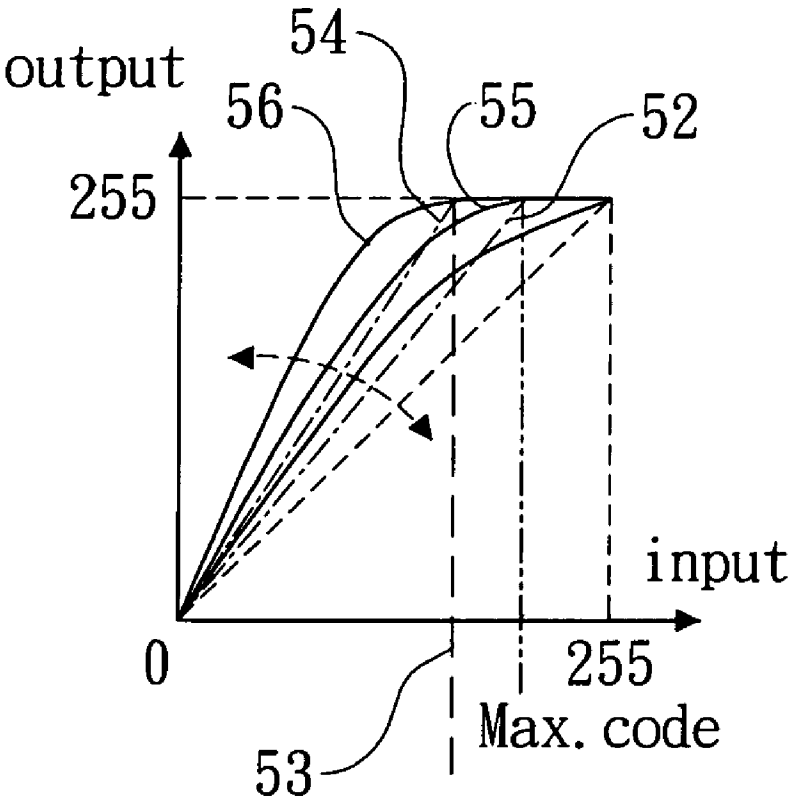
FIGS. 5A and 5B shows relations between corrected grayscale level and raw grayscale level in a first embodiment according to the present invention.
Figure 5B:
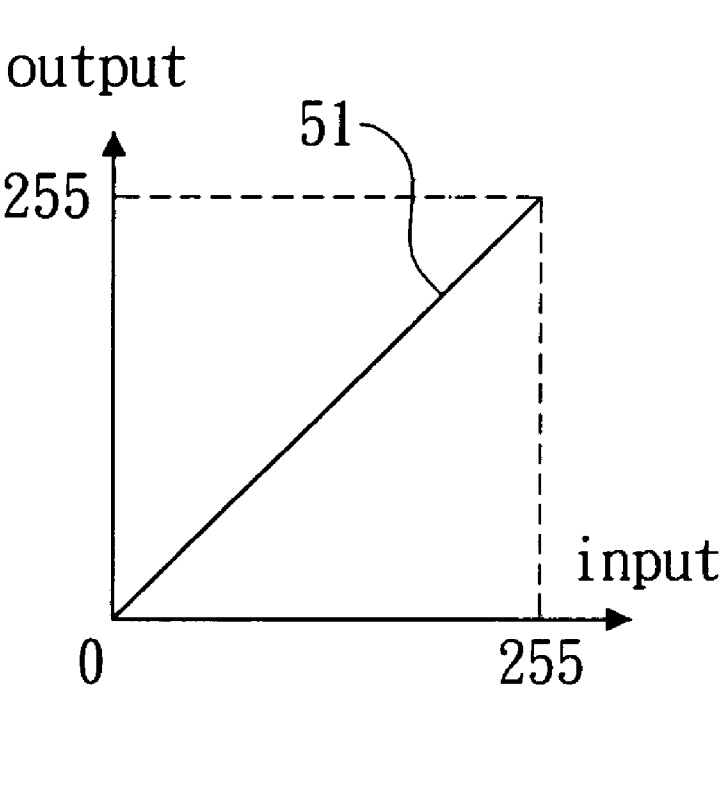

In the present invention, there are several ways to transfer the raw grayscale level to the corrected grayscale level. The followings are some exemplary relations between the raw and corrected grayscale levels:

The first embodiment of relations between the raw and corrected grayscale levels is shown on FIGS. 5A and 5B. X variable is denoted as "input" and responded to the raw grayscale level. Y variable is denoted as "output" and responded to the corrected grayscale level. Before any correction, the relation between input and output looks like a straight line as line 51 on Cartesian coordinate shown in FIG. 5A. A straight line as line 52 shown in FIG. 5B shows one of relations when maximum value (Max. code) of input is less 255. After correction, the maximum value (Max. code) of input is corresponded to value 255 for output. The relation can be represented as a following formula:

$$\text{Corrected grayscale level} = \text{Raw grayscale level} \times \frac{\text{Maximum of corrected grayscale level}}{\text{Maximum of raw grayscale level}} \quad (1)$$

By following the formula, the relation between input and output is a straight line as line 52 shown in FIG. 5B. In order to prevent useless correction, a lower limit 53 of grayscale level replaces the maximum of raw grayscale level when the maximum value of raw grayscale level is less than the lower limit of grayscale level. By following the formula and the lower limit of raw grayscale level, the relation between input and output is a straight line as line 54 shown in FIG. 5B.

Besides the straight-line relations, there are other relation curves for input and output as follows:

As well as line 52, a smooth curve as curve 55 also has a starting point at (0,0) and an end point at (maximum value of raw grayscale level, maximum value of corrected grayscale level) ((Max. code, maximum value of corrected grayscale level)). The difference is output value following curve 55 is greater than or equal to the one following line 52 at the same input value. One of smooth curves is negative gamma curve corresponding to light response of human's eyes. The maximum value of raw grayscale level is a variable of negative gamma function in order to fit different needs.

In order to prevent useless correction, a lower limit 53 of grayscale level replaces the maximum of raw grayscale level when the maximum value of raw grayscale level is less than the lower limit of grayscale level. The relation between input and output becomes a smooth curve as curve 56 shown in FIG. 5B.

Figure 6:
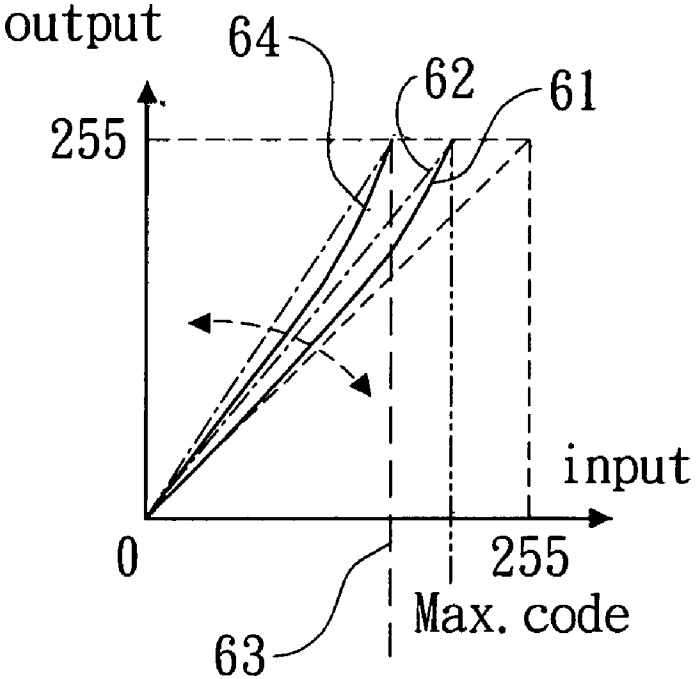
FIG. 6 shows relations between corrected grayscale level and raw grayscale level in a second embodiment according to the present invention.

Further, FIG. 6 shows the second embodiment of relation between input and output. As well as curve 55, the relation between input and output is a smooth curve through Cartesian coordinate (0,0) and (maximum value of raw grayscale level, maximum value of corrected grayscale level) ((Max. code, maximum value of corrected grayscale level)) marked as denotation 61. The difference is curve 61 is always lower than denotation 62. One of smooth curves is positive gamma curve corresponding to light response of human's eyes. The maximum value of raw grayscale level is a variable of positive gamma function in order to fit different needs. In order to prevent useless correction for too small maximum value of input, a lower limit 63 of grayscale level replaces the maximum of raw grayscale level when the maximum value of raw grayscale level is less than the lower limit of grayscale level. The relation between input and output becomes a smooth curve as curve 64 on FIG. 6.

Figure 7:
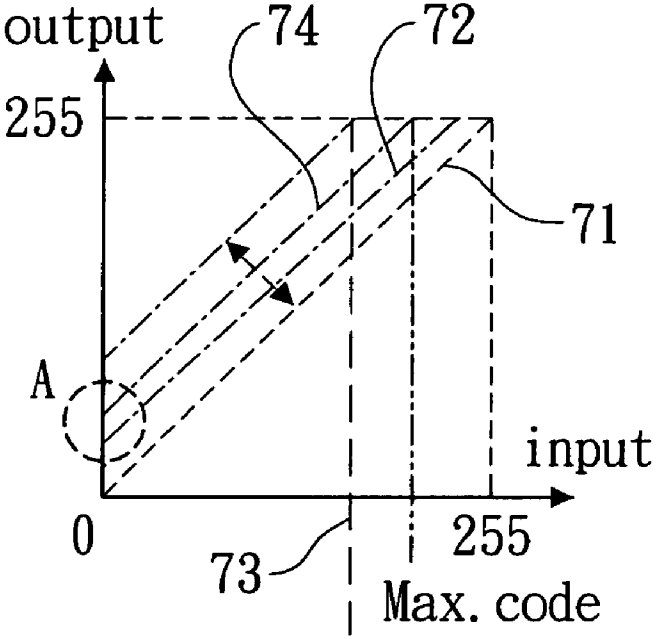
FIG. 7 shows relations between corrected grayscale level and raw grayscale level in a third embodiment according to the present invention.
Figure 7A:
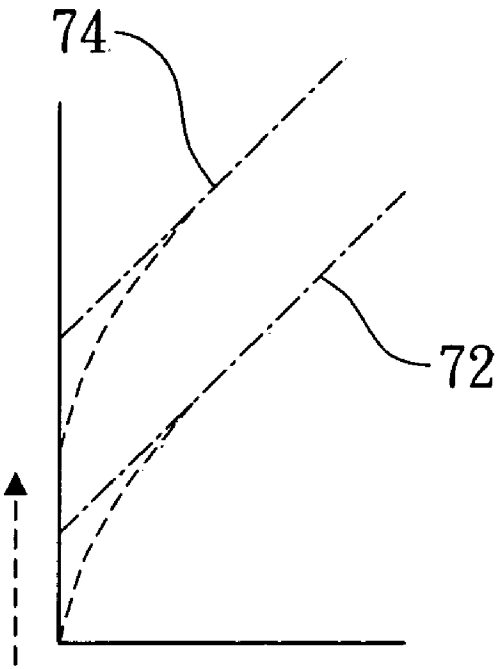
FIG. 7A shows a detail diagram for FIG. 7 at small input values.

Further, the third embodiment of relation between input and output is shown on FIG. 7. Changes of output and input at large values keep the same ratio as line 72 which is as well as the equal line 71 but with a horizontal shift on X axis. The maximum value of raw grayscale level (Max. code) is also corresponded to the maximum value of corrected grayscale level. FIG. 7A shows relation between input and output at small values is corrected to a concave curve for matching coordinate (0,0) at zero input. With the different maximum values of raw grayscale level, the concave curve near small values is different for matching coordinate (0,0).

In order to prevent useless correction, a lower limit 73 of grayscale level replaces the maximum of raw grayscale level when the maximum value of raw grayscale level is less than the lower limit of grayscale level. The relation between input and output becomes a smooth curve as curve 74 on FIG. 7.

Figure 8:
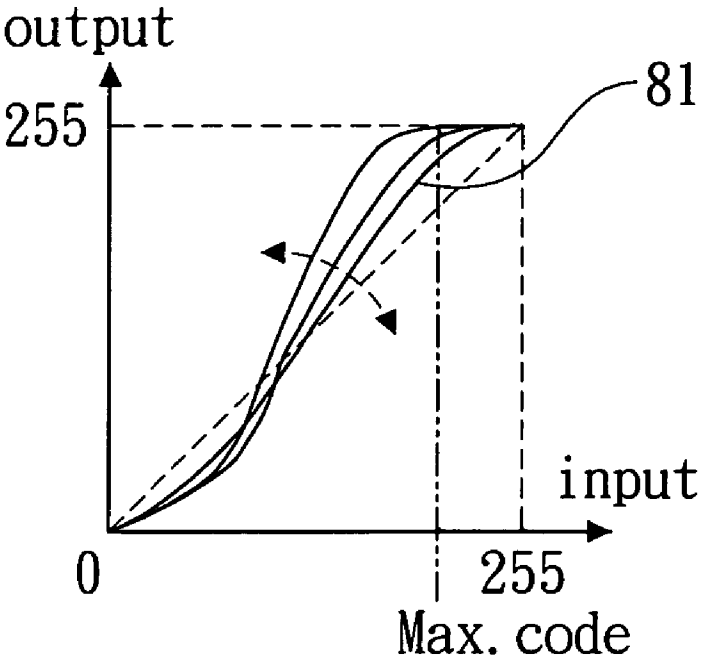
FIG. 8 shows relations between corrected grayscale level and raw grayscale level in a fourth embodiment according to the present invention.

Further, the fourth embodiment of relation between input and output is shown on FIG. 8. Curve 81 is one of exemplary curves for fifth embodiment. As well as other embodiments, curve 81 is a smooth curve linking between Cartesian coordinate (0,0) and (maximum value of raw grayscale level (Max. code), maximum value of corrected grayscale level). The difference is curve 81 is convex near large values and concave near small values as an S shape curve. As using curve 81 correction, it not only reduces backlight intensity and electrical power consumption but also enhance image contrast at the same time. In addition to curve 81, other curves with experimental facts can be used to enhance image quality for grayscale level correction.

No matter what correction is used for relation between the raw grayscale level and the corrected grayscale level, backlight brightness is changed to a lower intensity or higher intensity by backlight control unit depending on the corrected grayscale level. With the different light source and different needs of brightness control, the backlight control unit has many ways for brightness control as follows:

First way of the backlight control unit is to change all the brightness of light source of backlight module by the same amount for modification of whole panel brightness.

Second way of backlight control unit is to change the brightness of light source of backlight module on the same strip board by the same amount for strip-wise brightness modification.

Third way of backlight control unit is to change the brightness of light source of backlight module on the same area board by the same amount for area-wise brightness modification. The whole light source of backlight module can be divided into several rectangular areas. The third way of backlight control unit can control those different areas independently based on their corrected grayscale level. Because change of brightness is gradual in smaller region (i.e. the rectangular areas), brightness difference is harder to tell by human's eyes.

Those three ways of backlight control unit have their own advantages and disadvantages. Using one of them or combination of them can reduce electrical power consumption of backlight module and enhance image quality.

Figure 9:
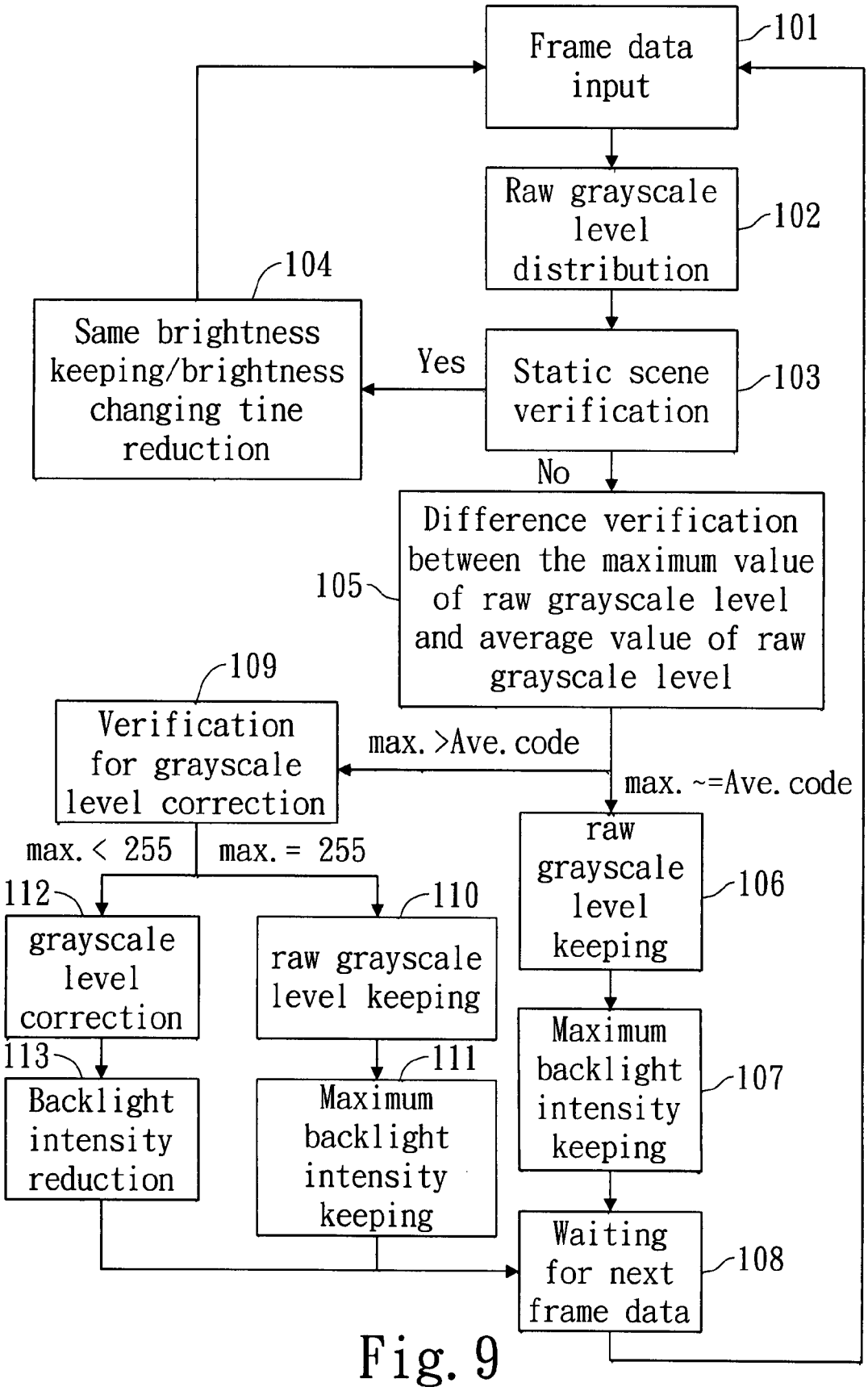
FIG. 9 shows a flowchart of an embodiment according to the present invention.

An operation embodiment according to the present invention is shown as a flowchart on FIG. 9. When a frame data is input (denotation101), it is passed to do statistical analysis (denotation102). Next, a static scene verification (denotation103) excuses command of brightness keeping or changing time reduction (denotation104) and returns the step of fame data inputting for static scene.

If the scene is not static, the dynamic backlight control is not necessary for every changed scene. For the present embodiment, the maximum value of raw grayscale level (Max) and the average value of raw grayscale level (Ave) are compared (denotation105) to verify the need of dynamic backlight control. When the difference is small, there is no need of the dynamic backlight control (denotation106) and maximum backlight intensity is remained (denotation107). Then, flowchart processing jumps to the starting step for waiting next frame data (denotation105).

When the difference is large, processing steps forward to verify the need of grayscale level correction (denotation109). As the maximum value of raw grayscale level is 255, there is no need of grayscale level correction (denotation111) and maximum backlight intensity is remained (denotation111). As the maximum value of raw grayscale level is less 255, processing steps forward to compute the corrected grayscale level from the correction relation (denotation112). According to the corrected grayscale level, backlight intensity can be modified to a lower intensity (denotation113) for power reduction. Then, flowchart processing jumps to the starting step for waiting next frame data (denotation108). In the present embodiment, any modification and change on the steps and verification is probably made from general knowledge in related technology field.

From an experimental test result, electrical power consumption of LCD backlight module can be save up to 25% and image quality can be enhanced too by using the present invention.

Accordingly, the objectives for electrical power saving, power consumption reduction and environment protection can be made successfully and image contrast and quality are also enhanced too by using the present invention. However, the present invention is not limited in the sequence of the present embodiments and reference diagrams, e.g. distribution statistics, relation between raw grayscale level and corrected level, backlight control unit.

Accordingly, as disclosed by the above description and accompanying drawings, the present invention surely can accomplish its objectives, and may be put into industrial use especially for mass product.

It should be understood that various modifications, variations, and appliance such as organic light-emitting diode (OLED) or plasma display panel (PDP) could be made from the teaching disclosed above by the person familiar in the art, without departing the spirit of the present invention.

What is claimed is:

1. A dynamic control method for controlling a backlight module of a liquid crystal display (LCD), wherein the backlight of the LCD is provided by a plurality of light sources of a backlight module and controlled by a backlight control unit, comprising the following steps:

receiving a frame data which is transferred to the LCD and consists of a plurality of raw grayscale level;

processing a statistical analysis for distribution of the plurality of raw grayscale level; and transferring a plurality of corrected grayscale level which results from the statistical analysis corresponding to the raw grayscale level to the backlight control unit and a data modification simultaneously, wherein a relationship between the corrected grayscale level and the raw grayscale level follows a formula:

$$\text{Corrected grayscale level} = \text{Raw grayscale level} \times \frac{\text{Maximum of corrected grayscale level}}{\text{Maximum of raw grayscale level}},$$

and the backlight control unit uses the plurality of corrected grayscale level to modify brightness of the backlight module and the data modification uses the plurality of corrected grayscale level to compare with the plurality of raw grayscale level for accurate display performance.

2. A dynamic control method for controlling a backlight module of an LCD according to claim 1, wherein a weighted-average of the raw grayscale level is calculated in the step of processing statistical analysis for uses of further analysis and determinant conditions.

3. A dynamic control method for controlling a backlight module of an LCD according to claim 1, wherein the bits of raw grayscale level can be truncated and represented as most significant bit (MSB) through a manner of bit truncation for reducing data process during the step of processing statistical analysis.

4. A dynamic control method for controlling a backlight module of an LCD according to claim 1, wherein all the brightness of light source of the backlight module can be changed by the same amount for whole brightness modification.

5. A dynamic control method for controlling a backlight module of an LCD according to claim 1, wherein the brightness of light source of backlight module on the same strip board can be changed by the same amount for strip-wise brightness modification.

6. A dynamic control method for controlling a backlight module of an LCD according to claim 1, wherein the brightness of light source of backlight module on the same area board can be changed by the same amount for area-wise brightness modification.

7. A dynamic control method for controlling a backlight module of an LCD according to claim 1, wherein a lower limit of grayscale level replaces the maximum of raw grayscale level when the maximum value of raw grayscale level is less than the lower limit of grayscale level.

8. A dynamic control method for controlling a backlight module of an LCD according to claim 1, wherein the raw grayscale level and the corrected grayscale level are variables of (X, Y) Cartesian coordinate respectively and the relationship between them is a curve through (0, 0) and (maximum of raw grayscale level, maximum of corrected grayscale level) on (X, Y) Cartesian coordinate.

9. A dynamic control method for controlling a backlight module of an LCD according to claim 8, wherein a lower limit of grayscale level replaces the maximum of raw grayscale level when the maximum value of raw grayscale level is less than the lower limit of grayscale level.

10. A dynamic control method for controlling a backlight module of an LCD according to claim 1, wherein a plurality of optimized grayscale level is transferred to a timing controller which sends the plurality of optimized grayscale level and a control signal to the LCD panel for brightness control after comparison between the raw grayscale level and the corrected grayscale level in order to optimize image performance.

11. A dynamic control method for controlling a backlight module of a liquid crystal display (LCD), wherein backlight of the LCD is provided by a plurality of light sources of the backlight module and controlled by a backlight control unit, comprising the following steps:

receiving a frame data which is transferred to the LCD and consists of a plurality of raw grayscale level;

processing a statistical analysis for distribution of the plurality of raw grayscale level; and transferring a plurality of corrected grayscale level which results from the statistical analysis corresponding to the raw grayscale level to the backlight control unit, wherein a relationship between the corrected grayscale level and the raw grayscale level follows a formula:

$$\text{Corrected grayscale level} = \text{Raw grayscale level} \times \frac{\text{Maximum of corrected grayscale level}}{\text{Maximum of raw grayscale level}},$$

and the backlight control unit uses the plurality of corrected grayscale level to modify brightness of the backlight module.

12. A dynamic control method for controlling a backlight module of an LCD according to claim 11, wherein a weighted-average of the raw grayscale level is calculated in the step of processing statistical analysis for uses of further analysis and determinant conditions.

13. A dynamic control method for controlling a backlight module of an LCD according to claim 11, wherein the bits of raw grayscale level can be truncated and represented as most significant bit (MSB) through a manner of bit truncation for reducing data process during the step of processing statistical analysis.

14. A dynamic control method for controlling a backlight module of an LCD according to claim 11, wherein all the brightness of light source of the backlight module can be changed by the same amount for whole brightness modification.

15. A dynamic control method for controlling a backlight module of an LCD according to claim 11, wherein the brightness of light source of backlight module on the same strip board can be changed by the same amount for strip-wise brightness modification.

16. A dynamic control method for controlling a backlight module of an LCD according to claim 11, wherein the brightness of light source of backlight module on the same area board can be changed by the same amount for area-wise brightness modification.

17. A dynamic control method for controlling a backlight module of an LCD according to claim 11, wherein a lower limit of grayscale level replaces the maximum of raw grayscale level when the maximum value of raw grayscale level is less than the lower limit of grayscale level.

18. A dynamic control method for controlling a backlight module of an LCD according to claim 11, wherein the raw grayscale level and the corrected grayscale level are variables of (X, Y) Cartesian coordinate respectively and the relationship between them is a curve through (0, 0) and (maximum of raw grayscale level, maximum of corrected grayscale level) on (X, Y) Cartesian coordinate.

19. A dynamic control method for controlling a backlight module of an LCD according to claim 18, wherein a lower limit of grayscale level replaces the maximum of raw grayscale level when the maximum value of raw grayscale level is less than the lower limit of grayscale level.

20. A dynamic control method for controlling a backlight module of an LCD according to claim 11 also comprises a step of transferring the plurality of corrected grayscale level to a data modification which uses the plurality of corrected grayscale level to compare with the plurality of raw grayscale level for computing a plurality of optimized grayscale level, wherein the plurality of optimized grayscale level is further transferred to a timing controller which sends the plurality of optimized grayscale level and a control signal to the LCD panel for brightness control in order to optimize image performance.

21. A dynamic control method for controlling a backlight module of a liquid crystal display (LCD), wherein the backlight of the LCD is provided with a plurality of light sources of the backlight module and controlled by a backlight control unit, comprising the following steps:

receiving a frame data which is transferred to the LCD and consists of a plurality of raw grayscale level;

processing a statistical analysis for distribution of the plurality of raw grayscale level, wherein the bits of raw grayscale level can be truncated and represented as most significant bit (MSB) through a manner of bit truncation for reducing data process during the step of processing statistical analysis; and transferring a plurality of corrected grayscale level which results from the statistical analysis corresponding to the raw grayscale level to the backlight control unit and a data modification simultaneously, wherein the backlight control unit uses the plurality of corrected grayscale level to modify the brightness of the backlight module and the data modification uses the plurality of corrected grayscale level to compare with the plurality of raw grayscale level for accurate display performance.

22. A dynamic control method for controlling a backlight module of a liquid crystal display (LCD), wherein the backlight of the LCD is provided with a plurality of light sources of the backlight module and controlled by a backlight control unit, comprising the following steps:

receiving a frame data which is transferred to the LCD and consists of a plurality of raw grayscale level;

processing a statistical analysis for distribution of the plurality of raw grayscale level; and transferring a plurality of corrected grayscale level which results from the statistical analysis corresponding to the raw grayscale level to the backlight control unit and a data modification simultaneously, wherein the raw grayscale level and the corrected grayscale level are variables of (X, Y) Cartesian coordinate respectively and the relationship between them is a curve through (0, 0) and (maximum of raw grayscale level, maximum of corrected grayscale level) on (X, Y) Cartesian coordinate, and the backlight control unit uses the plurality of corrected grayscale level to modify the brightness of the backlight module and the data modification uses the plurality of corrected grayscale level to compare with the plurality of raw grayscale level for accurate display performance.

23. A dynamic control method for controlling a backlight module of a liquid crystal display (LCD), wherein the backlight of the LCD is provided with a plurality of light sources of the backlight module and controlled by a backlight control unit, comprising the following steps:

receiving a frame data which is transferred to the LCD and consists of a plurality of raw grayscale level;

processing a statistical analysis for distribution of the plurality of raw grayscale level, wherein the bits of raw grayscale level can be truncated and represented as most significant bit (MSB) through a manner of bit truncation for reducing data process during the step of processing statistical analysis; and transferring a plurality of corrected grayscale level which results from the statistical analysis corresponding to the raw grayscale level to the backlight control unit, wherein the backlight control unit uses the plurality of corrected grayscale level to modify the brightness of the backlight module.

24. A dynamic control method for controlling a backlight module of a liquid crystal display (LCD), wherein the backlight of the LCD is provided with a plurality of light sources of the backlight module and controlled by a backlight control unit, comprising the following steps:

receiving a frame data which is transferred to the LCD and consists of a plurality of raw grayscale level;

processing a statistical analysis for distribution of the plurality of raw grayscale level; and transferring a plurality of corrected grayscale level which results from the statistical analysis corresponding to the raw grayscale level to the backlight control unit, wherein the raw grayscale level and the corrected grayscale level are variables of (X, Y) Cartesian coordinate respectively and the relationship between them is a curve through (0, 0) and (maximum of raw grayscale level, maximum of corrected grayscale level) on (X, Y) Cartesian coordinate, and the backlight control unit uses the plurality of corrected grayscale level to modify the brightness of the backlight module.

* * * * *